US007159604B2

(12) United States Patent
Schmidt et al.

(10) Patent No.: US 7,159,604 B2
(45) Date of Patent: Jan. 9, 2007

(54) MANIPULATOR SYSTEM FOR SERVICING A HYDRAULIC CHOKE

(75) Inventors: David A. Schmidt, Houston, TX (US); Robert F. Schmidt, Cypress, TX (US); John W. McCaskill, Jersey Village, TX (US)

(73) Assignee: Power Well Services, L.P., Houston, TX (US)

( * ) Notice: Subject to any disclaimer, the term of this patent is extended or adjusted under 35 U.S.C. 154(b) by 444 days.

(21) Appl. No.: 10/832,779

(22) Filed: Apr. 27, 2004

(65) Prior Publication Data

US 2005/0236046 A1 Oct. 27, 2005

Related U.S. Application Data

(60) Provisional application No. 60/508,177, filed on Oct. 2, 2003.

(51) Int. Cl.
*F16K 3/02* (2006.01)

(52) U.S. Cl. ..... 137/15.17; 137/315.27; 251/293; 251/318

(58) Field of Classification Search ..... 137/15.17, 137/15.18, 315.27; 251/121, 122, 318, 319, 251/293
See application file for complete search history.

(56) References Cited

U.S. PATENT DOCUMENTS

| | | | | |
|---|---|---|---|---|
| 3,930,457 | A | | 1/1976 | Dedman et al. |
| 4,161,185 | A | | 7/1979 | McConnell |
| 4,460,154 | A | | 7/1984 | Kunkle |
| 4,461,450 | A | * | 7/1984 | Soland et al. ..... 251/285 |
| 4,611,617 | A | | 9/1986 | Hewitt |
| 4,961,538 | A | | 10/1990 | Hewitt |
| 5,232,198 | A | * | 8/1993 | Boyles et al. ..... 251/129.12 |
| 5,485,869 | A | | 1/1996 | Haynes |
| D398,101 | S | | 9/1998 | Passien |
| 6,135,417 | A | | 10/2000 | Wadsworth et al. |

* cited by examiner

*Primary Examiner*—Kevin Lee
(74) *Attorney, Agent, or Firm*—Elizabeth R. Hall

(57) ABSTRACT

The present invention relates to an apparatus for use in field servicing a choke valve system. The apparatus is used for lifting, manipulating, and handling the heavy components of hydraulic choke valves. The apparatus includes an elongated track, a choke valve support structure, a trolley that selectably reciprocates along a length of the trolley, and an attachment mechanism for attaching a choke actuator to the trolley.

21 Claims, 11 Drawing Sheets

MANIPULATOR SYSTEM FOR SERVICING A HYDRAULIC CHOKE

CROSS REFERENCE TO RELATED APPLICATIONS

This application claims priority to pending U.S. Patent Application Ser. No. 60/508,177, filed Oct. 2, 2003 by Robert F. Schmidt, et al. and entitled "Manipulator System for Servicing a Hydraulic Choke."

BACKGROUND OF THE INVENTION

1. Field of the Invention

The present invention relates to an apparatus for use in servicing hardware used in the drilling and production of fluids from petroleum wells. More particularly, the present invention relates to a field servicing apparatus for lifting, manipulating, and handling the heavy components of hydraulic choke valves.

2. Description of the Related Art

Hydraulic choke devices are commonly used in the oilfield when drilling or treating wells. Herein, the term "hydraulic choke" is taken to refer to a device typically used as a pressure reducing valve with a variety of fluids, such as drilling mud, salt water, oil, gas, and other chemicals that are injected into or withdrawn from a well. "Hydraulic" does not herein refer to the choke actuation means. The service conditions for hydraulic chokes are typically severe, so that the units require frequent field servicing in order to minimize drilling or production downtime. Since the primary components of the choke system, namely the choke valve itself and its associated actuator, are very heavy and field working conditions are often difficult for handling the choke valve, an auxiliary manipulation means is needed to ease choke servicing.

Manipulator devices are use for simplifying the servicing of blowout preventers. However, easy-to-use manipulators for hydraulic choke valves have not been available previously.

Kunkle, U.S. Pat. No. 4,460,154, discloses a pair of telescoping tubes supported in a fixed relationship to a valve. One tube provides a mounting location for a linear actuator, while the other tube is stationary.

Hewitt, U.S. Pat. No. 4,961,538, discloses a valve operation system wherein a linear actuator is provided with a rod in a housing. The system components are held in place by a mounting plate that may be secured to a number of different valves through a valve stem adaptor.

Hewitt, in U.S. Pat. No. 4,611,617, discloses an apparatus mountable on an irrigation pipe for use in controlling valves within the pipe. The apparatus includes a mounting bracket attachable to the valve mechanism and mounting plates for various components of a drive mechanism, including an electric motor, a gear box, a main gear, and a drive chain.

None of these references disclose equipment that will simplify the lifting and manipulation of the heavy components of a choke valve. Power Chokes of Cypress, Texas has used a primitive manipulator for choke valves based on horizontally telescoping support tubes, wherein one tube is mounted to the body of the choke valve and the other tube has its end attached to the separable actuator of the choke valve. The first tube is able to pivot about a nominally vertical axis to permit adjusting the actuator alignment relative to the choke valve. However, this apparatus requires that the tubes remain in the horizontal plane so that high side loads do not cause inadvertent misalignment. Further stick-slip motion of this Power Chokes actuator made manipulation difficult.

A need exists for a simple to install, robust field service device for hydraulic choke valves which is insensitive to stick-slip behavior and misalignment.

SUMMARY OF THE INVENTION

The invention contemplates a choke valve manipulator device comprising: a frame; a mounting means for attaching a choke valve to the frame; and a rotation means for rotating the choke valve about an axis of a horizontal plane; whereby the manipulator device supports the weight of the choke valve and eases access to the choke valve components whenever the choke valve is serviced.

The invention further contemplates a choke manipulator device comprising: a frame; a mounting means for attaching a choke valve to the frame; and a tilt means for tilting the choke valve in a vertical plane; whereby the manipulator device supports the weight of the choke valve and eases access to the choke valve components whenever the choke valve is serviced.

Additionally, the invention contemplates a choke manipulator device comprising: a frame having an elongated track; a choke valve attachment structure positioned on an underside of the track; a reciprocable trolley, wherein the trolley moves along a length of the track; a trolley actuator in communication with the trolley, the trolley actuator causing the trolley to move along the length of the track; and a choke actuator attachment mechanism positioned on an underside of the trolley; whereby when the trolley is moved the choke actuator attachment is moved in the same direction.

Further, the invention contemplates a choke manipulator device comprising: a frame having an elongated track including two parallel mirror image channels; a choke valve attachment structure positioned on an underside of the track, the choke valve attachment structure rotatable about an axis of a horizontal plane; a reciprocable trolley having a plurality of mounted rollers, the rollers maintaining the trolley with the track; a trolley actuator in communication with the trolley, the trolley actuator causing the trolley to selectably reciprocate along a length of the track; and a choke actuator attachment mechanism positioned on an underside of the trolley; whereby whenever the trolley actuator moves the trolley the choke actuator attachment mechanism moves in the same direction as the trolley.

In addition, the invention contemplates a method for servicing a choke valve system, said method comprising the steps of: (i) positioning a choke valve manipulation device close to the choke valve system to be serviced, the choke valve manipulation device comprising: a frame having an elongated track, a choke valve attachment structure positioned on an underside of the track, a reciprocable trolley, wherein the trolley moves along a length of the track, a trolley actuator in communication with the trolley, the trolley actuator causing the trolley to move along the length of the track, and a choke actuator attachment mechanism positioned on an underside of the trolley; (ii) attaching a choke valve to the choke valve attachment structure; (iii) aligning the choke actuator attachment mechanism with a choke actuator connected to the choke valve; (iv) attaching the choke actuator to the choke actuator attachment mechanism; (v) disconnecting the choke actuator from the choke valve; (vi) activating the trolley actuator to cause the trolley to move away from the choke valve to separate the choke valve from the choke actuator; and (v) evaluating an interior component of the choke valve system for replacement or repair.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention provides a device for manipulating choke valve components during field service. The described manipulator is easily installed in the field and permits the easy and safe disassembly and reassembly of the choke valve components.

Figure 1:
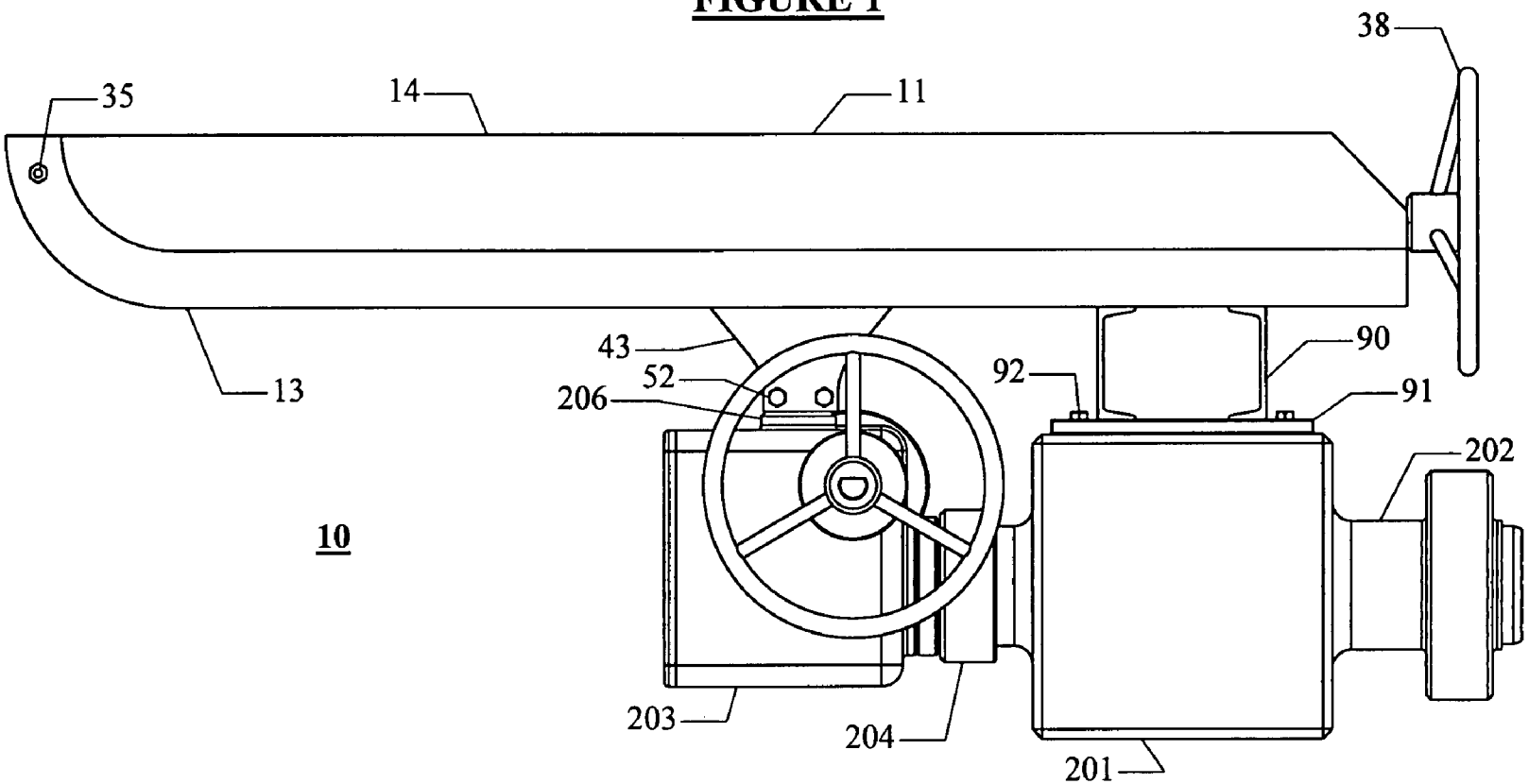
FIG. 1 is a profile view of the first manipulator embodiment assembled onto a choke valve assembly.

Referring now to the drawings, and initially to FIG. 1, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment.

Typical materials of construction of the choke valve manipulator are high strength low alloy steel or mild steel. In the case of plain bearings, bronze or a lubricious plastic such as Delrin™ or Teflon™, is generally used. FIGS. 1 to 7 illustrate a first embodiment 10 of a choke valve manipulator system.

FIG. 1 shows the choke valve manipulator system 10 assembled to the choke valve 201 and an adjoined electrically/manually powered actuator 203. The trolley subassembly 39 of the manipulator system 10 is shown in more detail in FIGS. 4, 5, and 6. FIG. 7 shows the manipulator of the first embodiment supporting the choke actuator, where the actuator 203 has been separated from the choke valve body 201.

Figure 2:
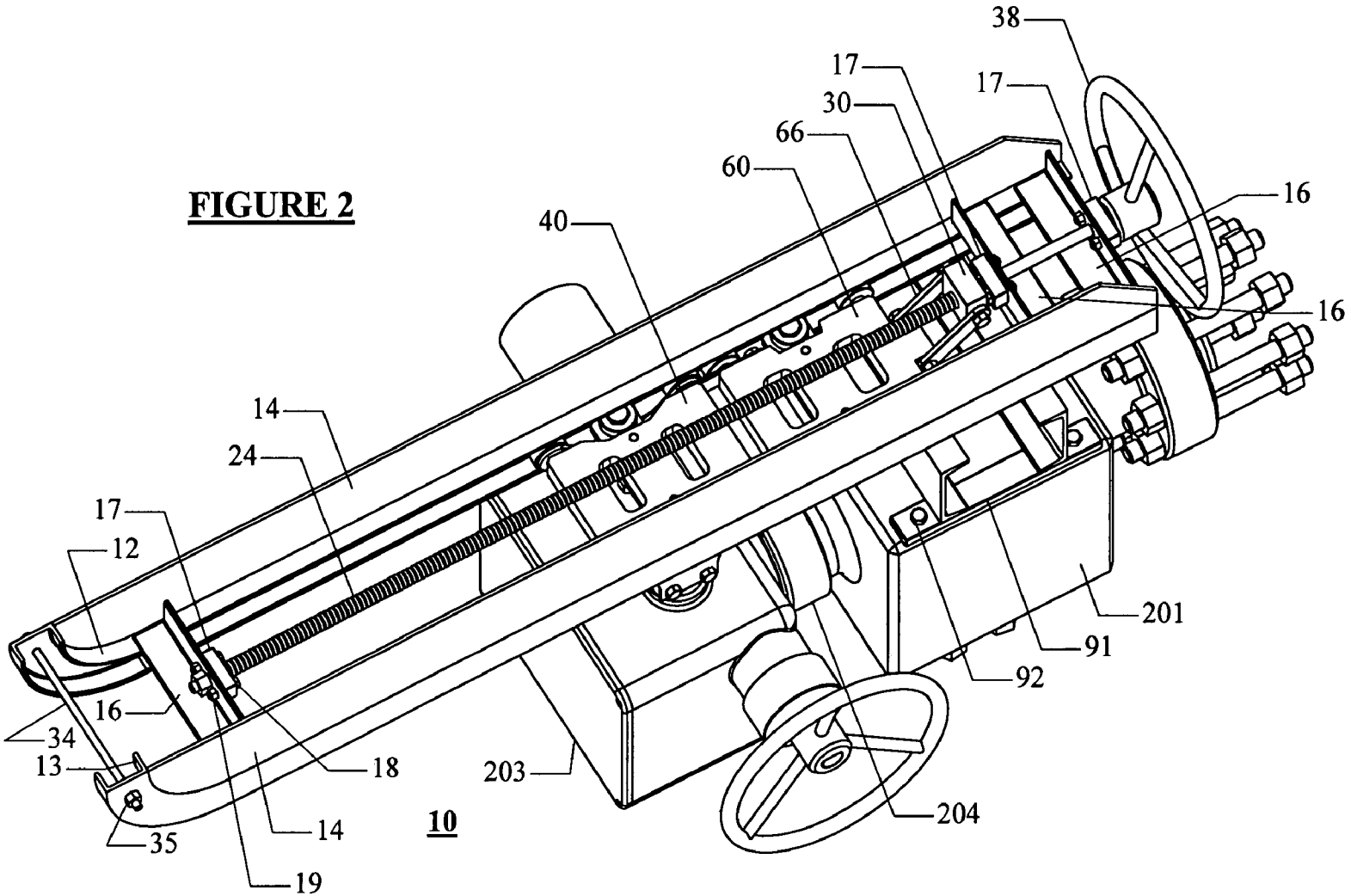
FIG. 2 is an oblique view from above and to the side of the first manipulator embodiment corresponding to FIG. 1.
Figure 3:
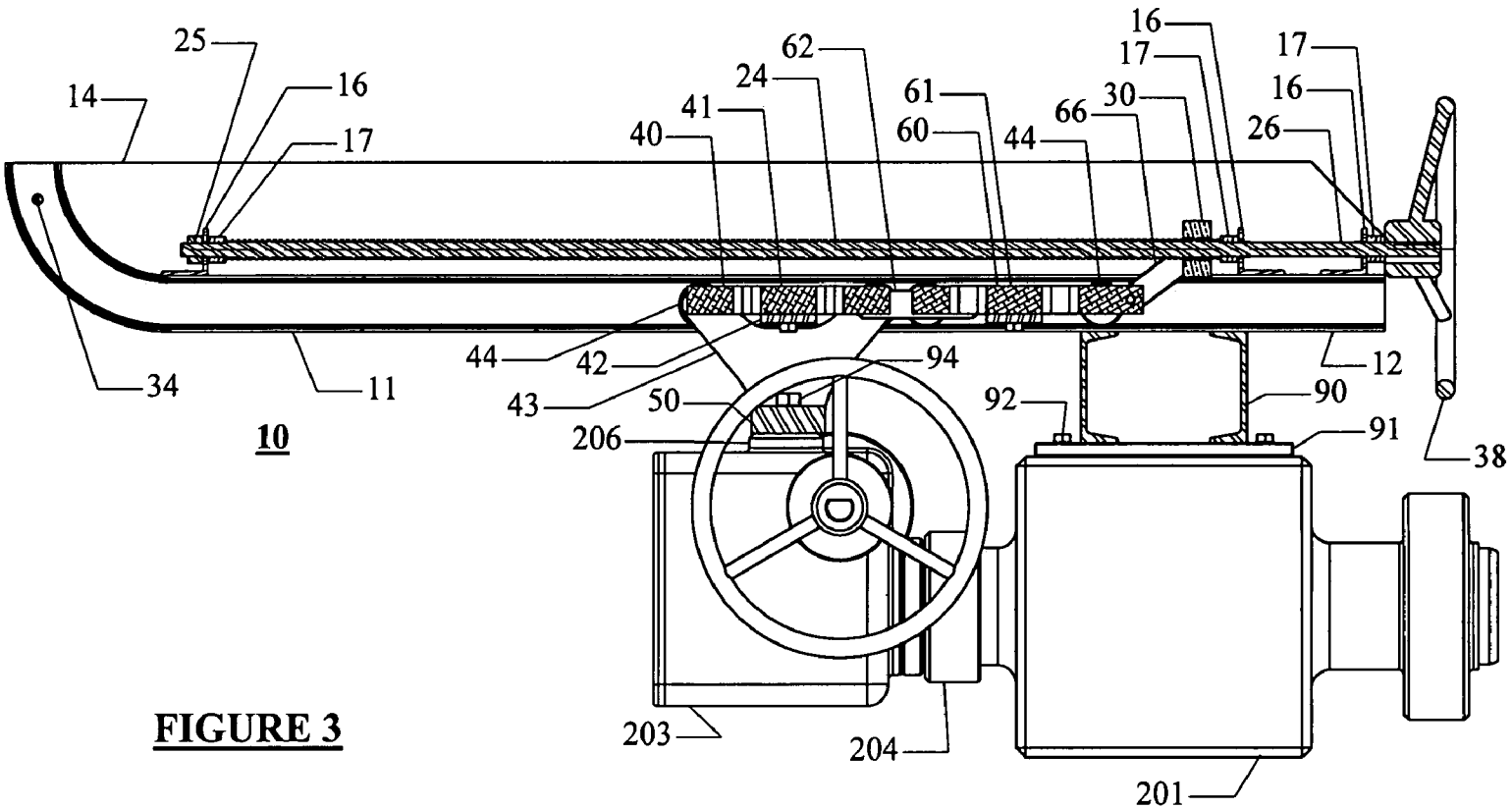
FIG. 3 is a longitudinal centerline cross-sectional view of the first embodiment of the manipulator assembly corresponding to FIG. 1.

Referring to FIGS. 1 to 3, the basic manipulator assembly 10 is shown in, respectively, profile, oblique, and longitudinal vertical cross-sectional views. The major components of the manipulator assembly include the track 11, the trolley subassembly 39 composed of a first trolley 40 and second trolley 60, and the supporting means for the manipulator including members 90, 91, and 92.

The track 11 is composed of two horizontal mirror image channels. The righthand channel 12 and the lefthand channel 13 have an extended linear section with a distal 90° arcuate curved end segment and vertical webs. To strengthen the track 11 in order to support the heavy loadings on the track, vertical flat plate stiffeners 14 are welded to the upper surface of each of the channels 12 and 13 in line with their webs. The stiffeners 14 are coped on their lower sides to conform to the upper surfaces of channels 12 and 13, while the upper corner of the stiffeners at the straight end of the track 11 has a large chamfer. The stiffeners 14 add both strength and rigidity to the track assembly 11.

The channels 12 and 13 are spaced apart parallel with their flanges projecting inwardly. Multiple angle crossmembers 16 are placed on top of the upper flanges and welded horizontally and perpendicularly to those upper flanges of the channels 12 and 13 in order to tie the channels together. For example, three crossmembers 16 are used in the track 11 as illustrated in FIGS. 2 and 3. One crossmember 16 is positioned adjacent to the start of the arcuate portion of the channels 12 and 13, another crossmember 16 is adjacent to the righthand end of the straight portion of the track 11, and a third crossmember 16 is spaced a short distance inwardly away from the second crossmember.

The vertical flange of each angle crossmember 16 has a central horizontal hole at approximately midheight to accommodate the trolley actuator screw 24. Additionally, on each side of the central hole at the same height and equispaced from the central hole is located a mounting hole for the attachment of a plain bearing 17. Plain bearing 17 is typically a rectangular prismatic block with a central horizontal hole for journaling the actuator screw 24. Whenever the bearing 17 has its central hole aligned with that of a crossmember 16, the mounting holes match the mounting holes of the angle crossmembers 16. Bearing retainer screws 18 and bearing retainer nuts 19 are used with the mounting holes of the crossmembers 16 and the bearings 17 to coaxially attach the bearings 17 to the crossmembers 16.

The trolley actuator screw 24 is a long right circular cylindrical rod with a male threaded central section, a short reduced diameter first end having a male thread at its distal end, and an elongated reduced diameter shank 26 at the other end. The extreme end of the shank 26 has a flat offset from the cylindrical screw axis so that the actuator screw handwheel 38 can be attached. The diameters of the said first end of the screw 24 and its shank 26 are the same and are a slip fit to the bearings 17.

The trolley actuator screw 24 is mounted in the set of bearings 17 so that the first end of the screw 24 is supported in the bearing 17 near the arcuate end of the track 11 and the shank 26 at the opposite end of the screw 24 is supported in the other two bearings 17. The actuator screw 24 is retained in place by actuator screw retainer nut 25 that is attached to the thread at the first end of the actuator screw 24.

A rectangular prismatic driven nut 30 has a central horizontal through hole 31 which is drilled and tapped with a female thread mateable with the male thread of the trolley actuator screw 24. The driven nut 30 is threadedly engaged with the screw 24 between the first and third bearings 17 of the track 11. A horizontal drilled and tapped hole with its axis intersecting the axis of threaded hole 31 is located on each of the lateral sides of driven nut 30. The drilled and tapped lateral holes in driven nut 30 are used to attach the driven nut 30 to the trolley subassembly 39 and to prevent the rotation of driven nut 30. A conventional handwheel 38 is attached to the actuator screw 24 adjacent the straight end of the track 11 by means of the flat on the shank 26 of the screw.

The trolley actuator screw 24 is axially fixed with the nut 25, yet turning the handwheel 38 will rotate the screw 24. As the handwheel 38 rotates the actuator screw 24, the nonrotating driven nut 30 is selectably caused to reciprocate along the threaded axis of the screw 24.

Figure 4:
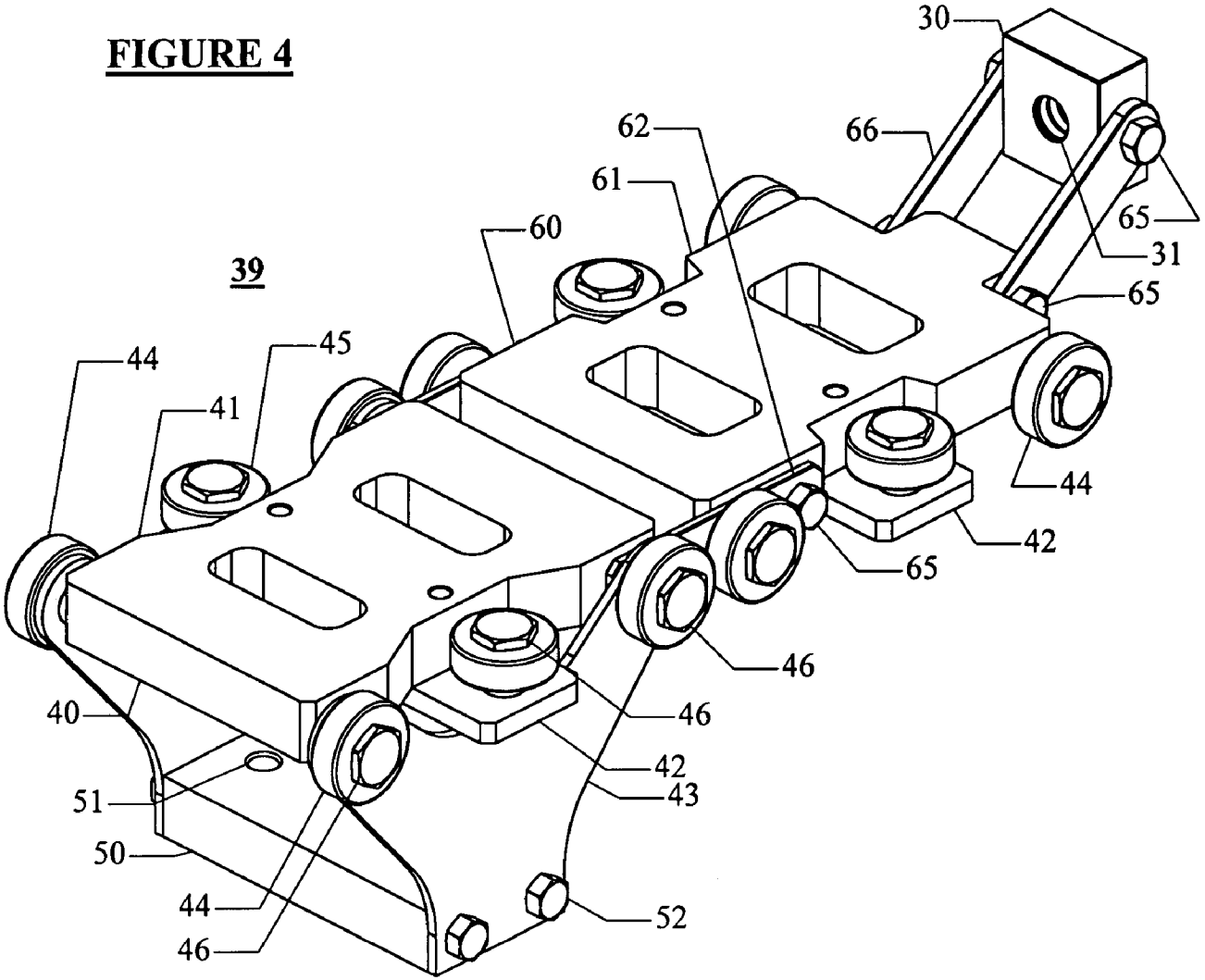
FIG. 4 is an oblique view of the trolley subassembly of the first embodiment from above and to the side.
Figure 5:
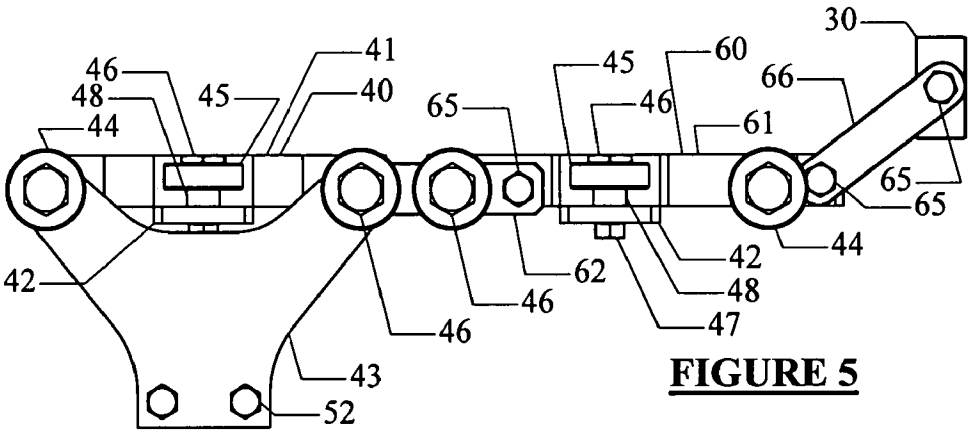
FIG. 5 is a side profile view of the trolley subassembly of FIG. 4.
Figure 6:
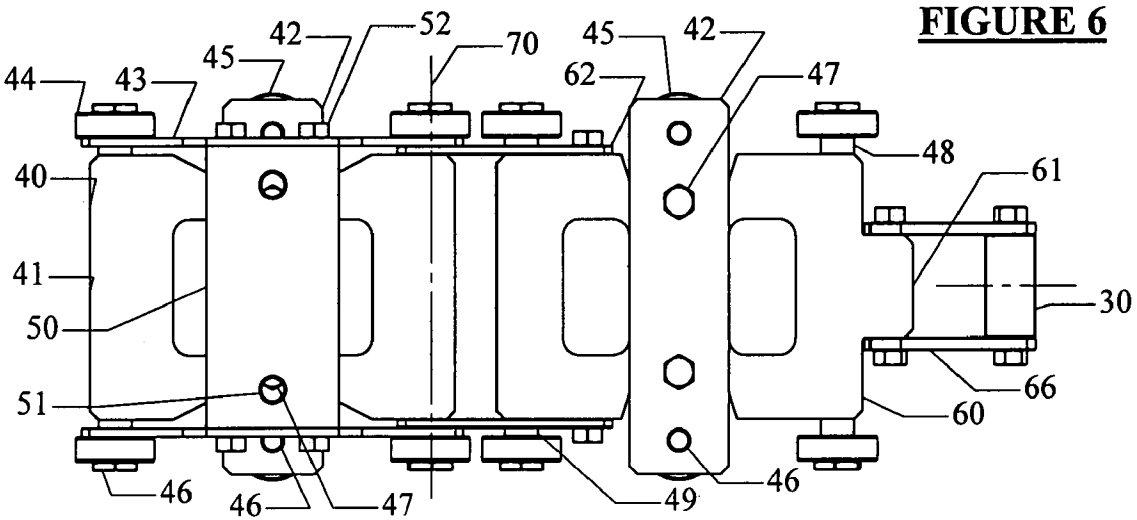
FIG. 6 is a plan view of the trolley subassembly of FIG. 4.
Figure 7:
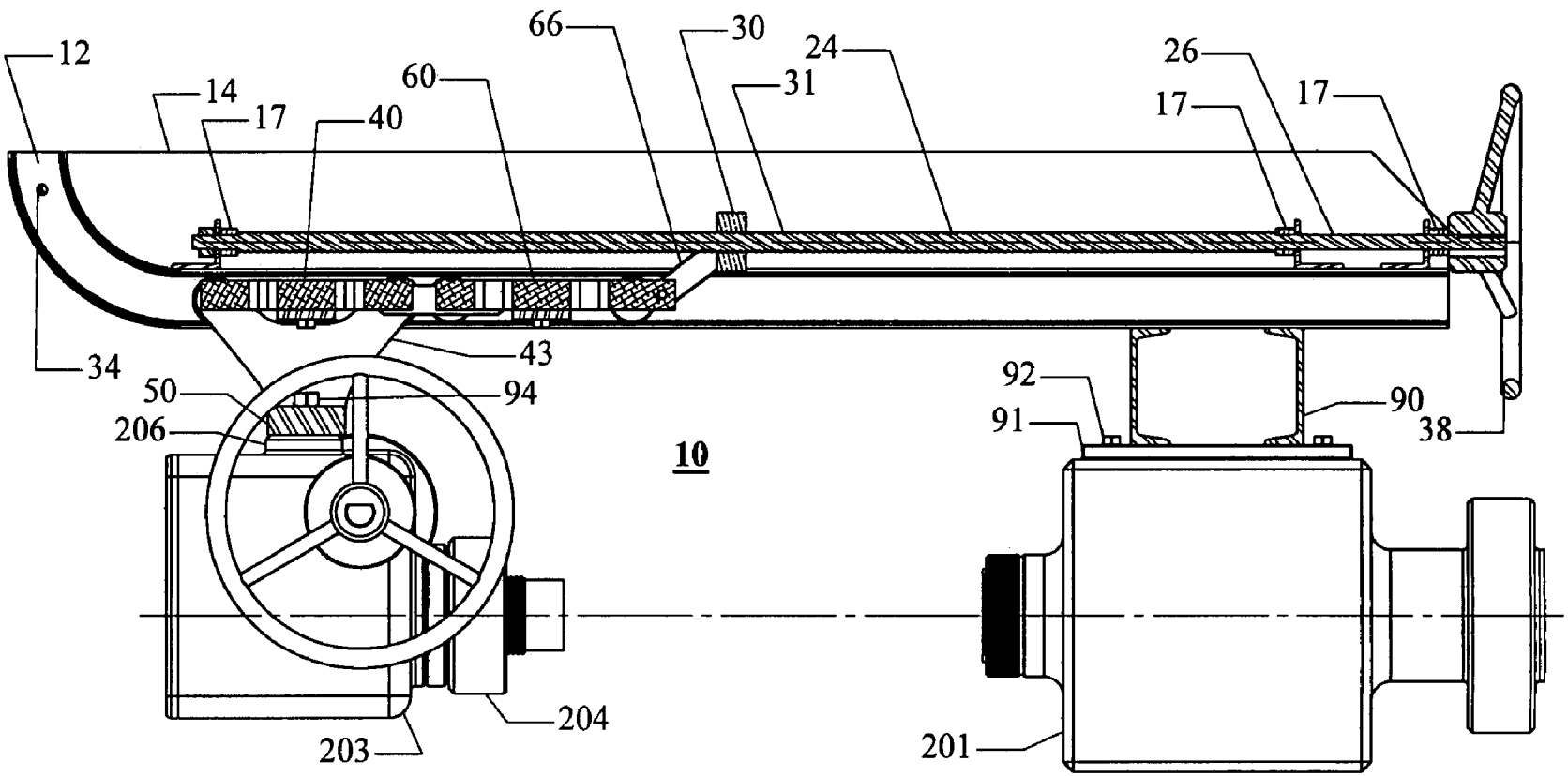
FIG. 7 is a longitudinal centerline cross-sectional view of the first embodiment of the manipulator assembly corresponding to FIG. 1 and showing the choke actuator separated from the choke valve body and supported by the trolley.

The trolley subassembly 39, shown in detail in FIGS. 4 to 6, consists of a first trolley 40 and a second trolley 60, which are linked to pivot about a central horizontal axis 70. The trolley assembly 39 is mounted to reciprocate within track 11 between the inwardly facing flanges of the track. The trolley assembly 39 can be caused to enter the arcuate end of the track 11 and is limited in its travel by a travel stop bar 34. The travel stop bar 34 is a threaded right circular cylindrical rod which extends from righthand channel 12 across the track 11 to lefthand channel 13. The travel stop bar 34 is mounted horizontally and extends through coaxial corresponding transverse holes located near the upper arcuate end of channels 12 and 13. The travel stop bar 34 is retained in position by a travel stop bar nut 35 on each of its external ends.

The first trolley 40 is configured to support the choke actuator 203 under the track 11. The second trolley 60 contributes vertical support to the first trolley 40 and, because it is attached to the driven nut 30, serves to transmit horizontal positioning loads to the first trolley 40.

First trolley 40 consists of a backbone plate body 41 with mounted vertical restraint rollers 44 and horizontal restraint rollers 45 to maintain and control the position of the trolley 40 within the guiding track 11. The first trolley body 41 is a thick horizontal plate having a generally rectangular outline with a reduced width central "waist" and lightening holes. Transverse horizontally drilled and tapped holes are located slightly below midheight near the four corners of the body 41. Each of these holes serves to mount a horizontal support roller 44 on a shaft provided by a roller mounting screw 46.

A rectangular prismatic flat crossbar 42 is transversely mounted underneath body 41 at about midlength of the body. The crossbar 42 is attached to the body 41 by hex screws 47 engaged into drilled and tapped holes in the body. The crossbar 42 mounts a vertical restraint roller 45 on each side of the body 41. A vertical restraint roller 45 is mounted at each end of the upper side of the crossbar 42 by a vertical roller mounting screw 46 that passes through a drilled and tapped hole in the crossbar 42.

Dependent plates 43 are Y-shaped with the arms of the Y up and clearance holes at the upper tips of the Y and a pair of bolt holes at the bottom. The central notch of the Y permits the plates 43 to clear the crossbar 42. The holes at the upper end of the Y are positioned to be a slip fit to the horizontal roller mounting screws 46 and are positioned thereon. At the left end of the first trolley 40 as shown in the figures, each dependent plate 43 is spaced away from the body 41 by a short right circular cylindrical tubular second cylindrical spacer 49, which is concentrically mounted on a horizontal roller mounting screw 46. At the right end, each dependent plate is spaced away from the body 41 by an intertrolley connector link having the same thickness as the cylindrical spacer 49. Each horizontal roller mounting screw 46 at the right end of the body 41 passes through, from its hex head end, a vertical support roller 44, a dependent plate 43, and an intertrolley connector link 62. The coaxial righthand horizontal roller mounting screws 46 on body 41 provide a horizontal rotational axis for flexing in the vertical plane of the trolley assembly 39.

A large crossbar 50, used to support the choke actuator 203, is a thick rectangular prismatic plate mounted horizontally at the bottom ends of the Y of the spaced apart parallel dependent plates 43 by mounting screws 52 engaged in the bottom holes of the plates 43 and drilled and tapped horizontal holes in crossbar 50. Crossbar 50 has on its center vertical transverse plane two symmetrically spaced apart vertical hanger screw holes 51 which correspond to similar drilled and tapped holes in bosses 206 on the upper surface of the choke valve actuator 203. Hanger screw holes 51 mount downwardly extending actuator hanger screws 94 for attaching to the actuator.

The second trolley 60 is very similar to first trolley 40 in construction, but with the following differences. The body 61 of second trolley 60 is similar to that of the body 41 except for a short rectangular horizontal prismatic protrusion on its righthand end centerline. The protrusion has opposed horizontal coaxial drilled and tapped holes for mounting a pair of link attachment screws 65. Additionally, spaced toward the center of body 61 from the lefthand mounting holes for the horizontal axis vertical support rollers 44 and their roller mounting screws 46 is another pair of opposed horizontal coaxial drilled and tapped holes for mounting a pair of link attachment screws 65.

The first and second trolleys are linked together with a horizontal intertrolley connection link 62. The intertrolley connection link 62 is rigidly mounted to the body 61 on each lefthand lateral side by a link attachment screw 65 and a roller mounting screw 46. The intertrolley connection link 62 is a vertical rectangular flat plate which is horizontally elongated to extend leftward beyond body 61 and has three horizontal through holes. The leftmost through hole is journaled on a righthand horizontal roller mounting screw 46 of trolley 40 and the middle hole is a slip fit onto the lefthand horizontal roller mounting screw 46 of trolley 60. The righthand hole is a slip fit for a link attachment screw 65 as described above. This arrangement of the horizontal intertrolley connection link 62 permits the first and second trolleys to pivot about horizontal axis 70 that is coaxial with the horizontal axis of the righthand vertical support rollers 44 of trolley 40. The lefthand vertical support roller screw 46 of second trolley 60 has a second cylindrical spacer 49 located between the roller 44 and link 62. The righthand vertical support roller screws 46 spaces the roller 44 outwardly from body 61 by a first cylindrical spacer 48 that is similar to the second spacer 49, but longer.

A rectangular elongate attachment link 66 having a horizontal through hole at each end is positioned in the vertical plane and lapped onto each side of the rightward protrusion of body 61, where it is journaled at one end by a screw 65. The other end of each attachment link 66 is journaled on a second screw 65 that is mounted in one of the horizontal transverse holes in driven nut 30. This arrangement permits the relative alignment of second trolley 60 to vary with regards to the axis of actuator screw 24 as the track 11 departs from being parallel to screw 24.

A support structure, as shown in FIG. 7, is provided to rigidly mount the track 11 with its trolley assembly 39 to the choke valve 201. Symmetrically positioned and transversely mounted by welding to channels 12 and 13 underneath track 11 at their righthand ends are a pair of channel crossmembers 90. The webs of channels 90 are vertical and parallel and their flanges face inwardly in an opposed fashion. Parallel to and symmetrically spaced apart from the longitudinal centerline of track 11 are elongate rectangular choke mounting bars 91, which are attached by welding symmetrically to the outer ends of the lower flanges of crossmembers 90. The distal ends of the bars 91 have vertical holes mounting downwardly extending choke mounting screws 92. The hole pattern in the bars 91 corresponds to an array of drilled and tapped mounting holes in the upper surface of choke valve 201.

Figure 8:
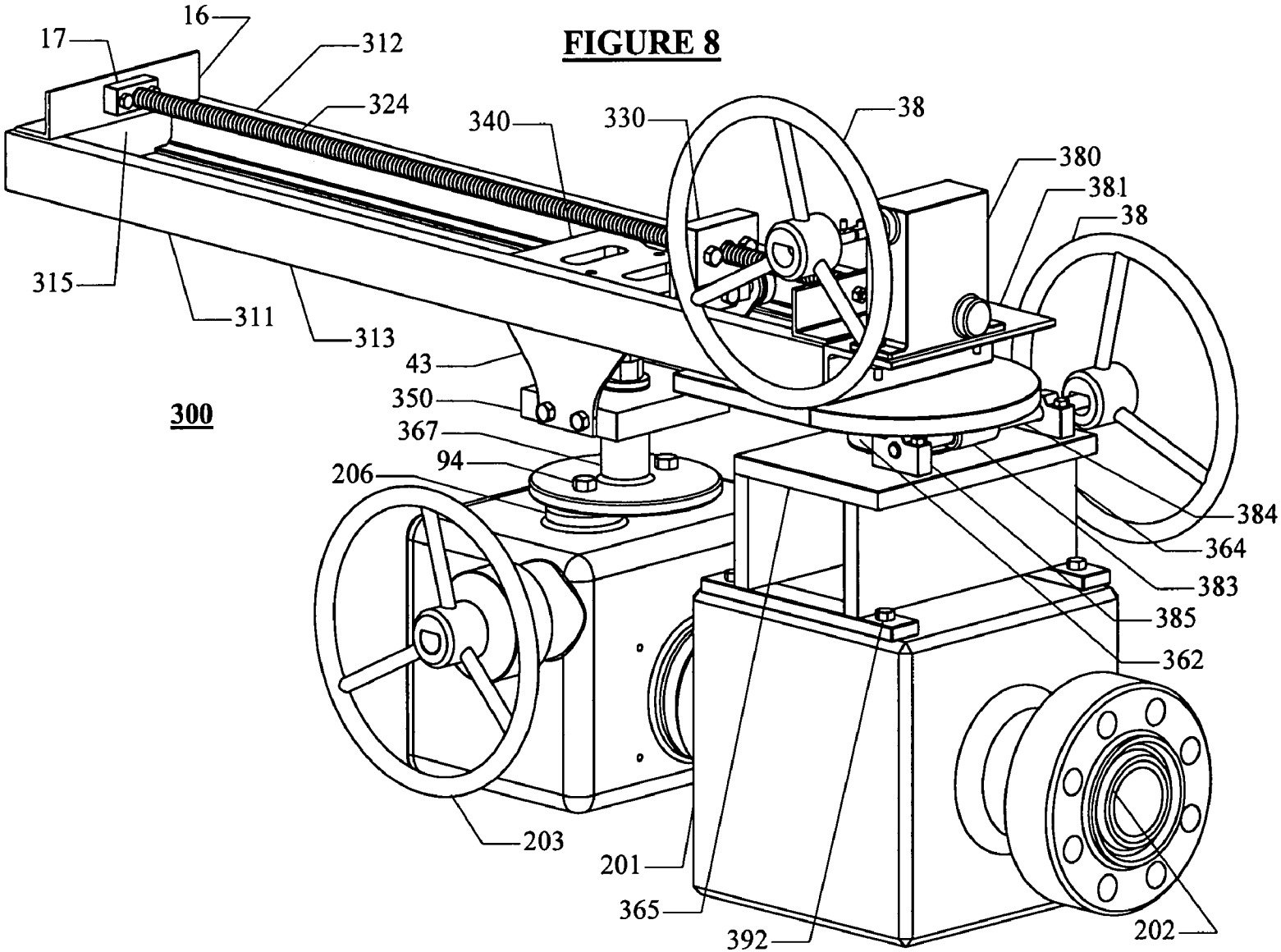
FIG. 8 is an oblique view from the rear quarter of the second manipulator embodiment assembled onto a choke valve assembly.
Figure 9:
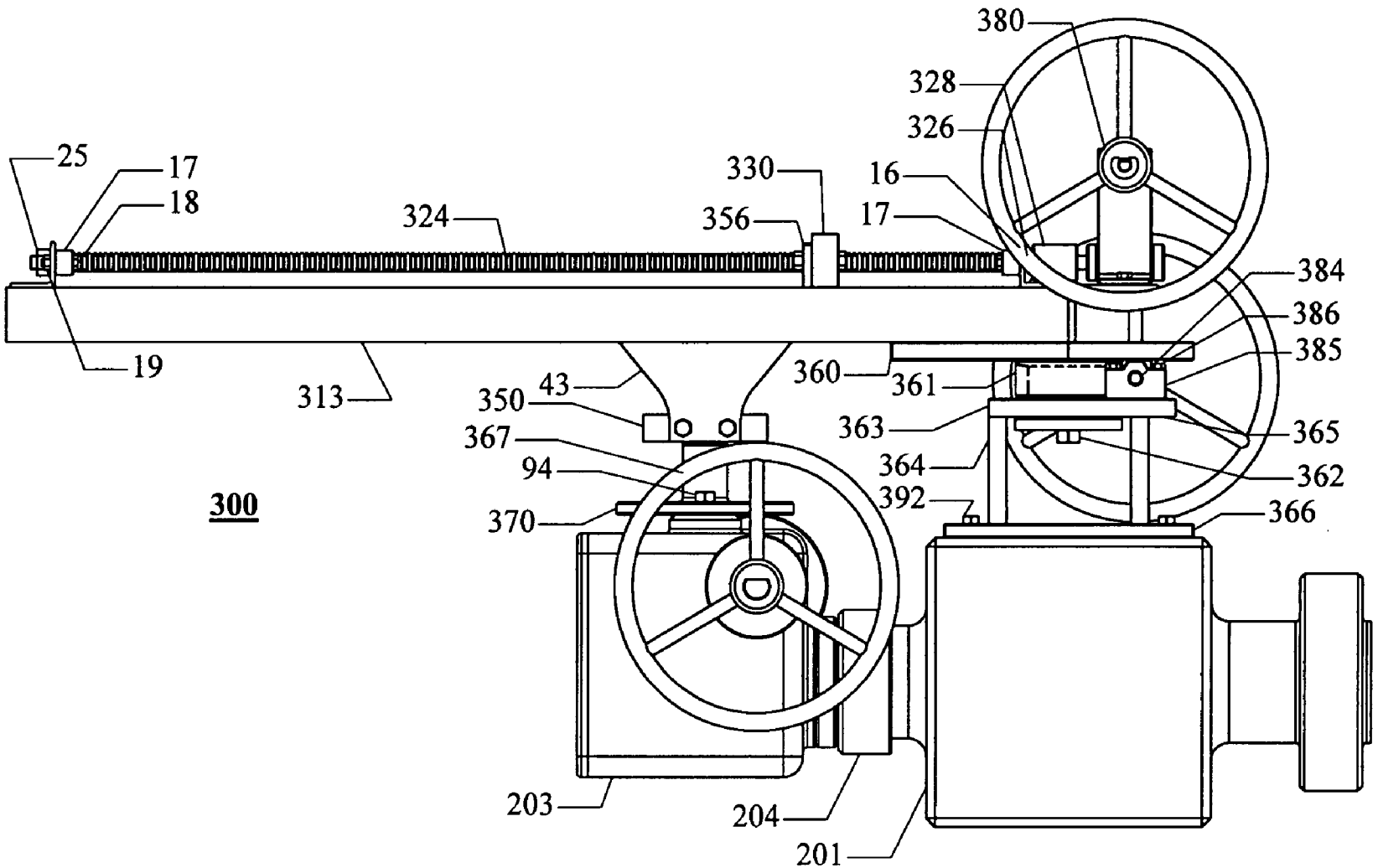
FIG. 9 is a profile view of the second manipulator embodiment shown in FIG. 8 assembled onto a choke valve assembly.
Figure 10:
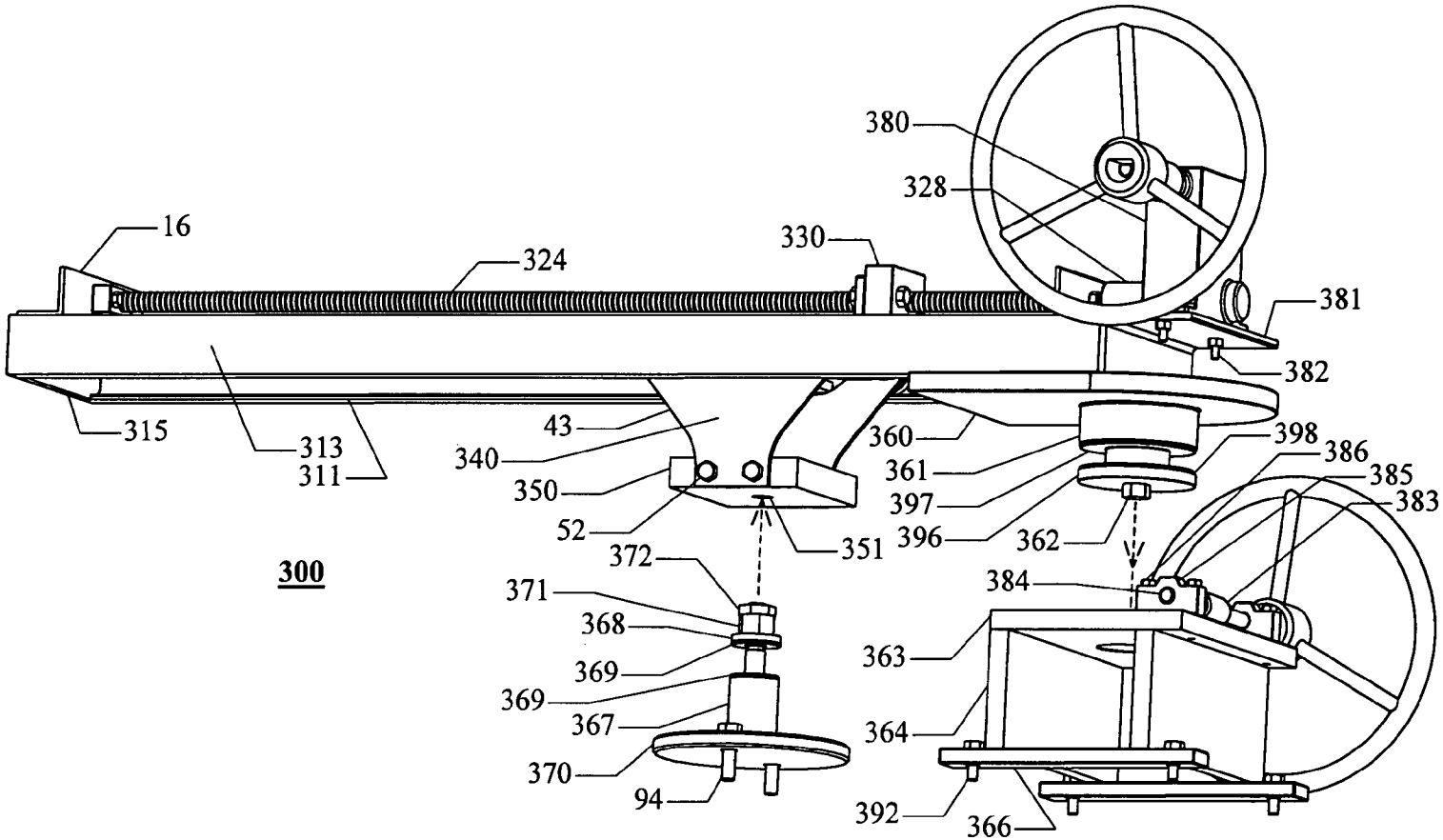
FIG. 10 is an oblique exploded view of the second manipulator embodiment wherein the relatively rotatable components are displaced from each other for exposure of their working mechanisms.

An alternative embodiment of the choke manipulator 300 is shown in FIGS. 8 to 12. the choke manipulator 300 can be both rotated in the horizontal plane and reciprocated toward and away from the choke valve body 201. Referring to FIGS. 8 to 10, the basic manipulator assembly 300 is shown in an oblique, side profile, and oblique exploded views. The major components of the manipulator assembly include track 311, the trolley assembly 340, and the supporting means for the manipulator 300, which consists of members rotator base 359 and choke mounted base 363. The actuator 203 is supported by an actuator hanger 367, which is dependent from the trolley 340 and is rotatable about a vertical axis.

The track 311 is composed of horizontal mirror image righthand and lefthand straight channels, 312 and 313 respectively, which have vertical webs. Vertical stiffeners for the track 311 are not shown in this case, but could be included readily in a manner similar to that used with plates 14 on the track 11 of the first manipulator embodiment 10. The channels 312 and 313 are spaced apart parallel with their flanges projecting inwardly. A generally rectangular transverse plate 315 is coped to fit between the flanges of channels 312 and 313 and welded at the outer end of the track 311 to rigidize the track and provide an end stop.

Multiple angle crossmembers 16 are placed on top of the upper flanges and welded horizontally and perpendicularly to those upper flanges of the channels 12 and 13 to tie the channels together to form a track. For example as shown in FIGS. 9 and 10, two crossmembers 16 are used. One crossmember 16 is placed adjacent the lefthand end of the channels 312 and 313 and another crossmember 16 is placed at the righthand end of the channels.

The vertical flange of each angle crossmember 16 has a central horizontal hole at approximately midheight to accommodate the actuator screw 324. Additionally, on each side of the central hole at the same height and equispaced from the central hole is located a mounting hole for the attachment of a plain bearing 17. Plain bearing 17 is a rectangular prismatic block with a central horizontal hole for journaling the actuator screw 324 and mounting holes matching those of the angle crossmembers 16 when the bearing has its central hole aligned with that of the crossmembers. Bearing retainer screws 18 and bearing retainer nuts 19 are used with the mounting holes of the crossmembers 16 and the bearings 17 to coaxially attach the bearings to the crossmembers.

Actuator screw 324 is a long right circular cylindrical rod with a male threaded central section, a short reduced diameter first (lefthand) end having a male thread at its distal end, and a short reduced diameter shank 326 at its second end. The extreme end of the shank 326 has a flat offset from the cylindrical screw axis so that shaft coupling 328 can be attached. The diameters of the first end of the screw 324 and the shank 326 are generally about the same and are a slip fit to the bearings 17. The screw 324 is mounted in the set of bearings 17 so that the first end of the screw is supported in the bearing near the outer end of the track 311, while the shank 326 of the screw is supported in the other bearing 17. Actuator screw 324 is retained in place by actuator screw retainer nut 25 being attached to the thread at the first end of the actuator screw 324.

A rectangular prismatic driven nut 330 has a central horizontal through hole 331 which is drilled and tapped with a female thread mateable with the male thread of actuator screw 324. The driven nut 330 is threadedly engaged with the screw 324 between the bearings 17 of the track 311. Horizontal through holes with their axes parallel to and laterally offset from the axis of threaded hole 331 are located in driven nut 330. The drilled and tapped holes in driven nut 330 are used to prevent its rotation.

A conventional handwheel 38 is attached to the worm gear reduction gear box 380 by means of a second coupling 328 so that the axis of the handwheel projects horizontally transverse to the axis of the track 311. The output shaft of the reduction gearbox 380 projects horizontally parallel to and in the direction of the longitudinal axis of track 311. Reduction worm gear box 380 is attached to actuator screw 324 adjacent the inner end of the track 311 by means of the coupling 328 on the adjacent second end of the actuator screw.

Although the nut 25 axially fixes the screw 324, the screw 324 can be rotated by handwheel 38 acting through gearbox 380 so that nonrotating driven nut 330 can be selectably caused to reciprocate along the axis of the screw. Gearbox 380 is mounted on bracket angle 381, which is transversely mounted by welding at the extreme righthand end of track 311 by its vertical downwardly projecting flange and with its long flange horizontal and projecting to the right. The horizontal flange of bracket angle 381 is drilled for mounting gearbox 380 by means of multiple screw and nut pairs 382. The horizontal flange of bracket angle 381 is at approximately the same height as the upper flange of the channels 312 and 313.

Figure 11:
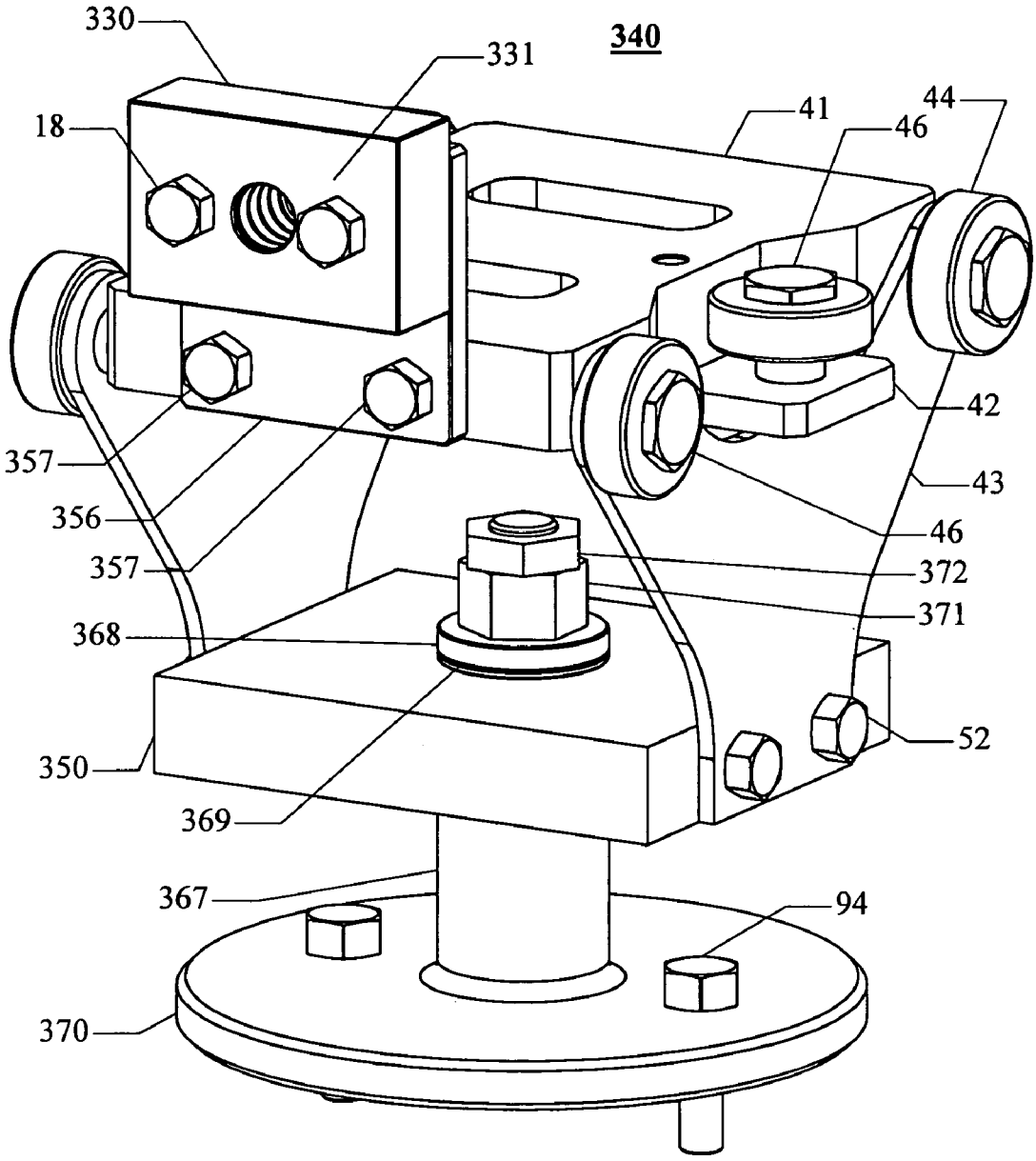
FIG. 11 is an oblique view of the trolley of the second manipulator embodiment.

The trolley subassembly 340, shown in detail in FIG. 11, is very similar to the first trolley 40 of the first embodiment 10 of the present invention and uses most of the same components. The trolley subassembly 340 is mounted to reciprocate within track 311 between the inwardly facing flanges of the track. Trolley 340 is configured to support the actuator 203 of the choke under the track 311. Trolley 340 consists of a backbone plate body 41 mounting horizontal 45 and vertical 44 restraint rollers to maintain and control the position of trolley 340 within the guiding track 311. First trolley body 41 is a thick horizontal plate having a generally rectangular outline with a reduced width central "waist" and lightening holes.

Transverse horizontally drilled and tapped holes are located slightly below midheight near the four corners of the body 41 and each serves to mount a vertical support roller 44 on a shaft provided by a roller mounting screw 46. A rectangular prismatic flat crossbar 42 is transversely mounted underneath the body 41 at about midlength of the body 41. Two hex screws 47 engaged into drilled and tapped holes in the body 41 support the crossbar 42. In a drilled and tapped hole in the crossbar on the upper side of each of the upper outer tips of the crossbar 42, a vertical roller is mounted on the crossbar 42 by a mounting screw 46 that also supports a coaxial horizontal support roller 45.

Dependent plates 43 are Y-shaped with the arms of the Y up and clearance holes at the upper tips of the Y and a pair of bolt holes at the bottom. The central notch of the Y permits the plates 43 to clear the crossbar 42. The holes at the upper end of the Y are positioned to be a slip fit to the horizontal roller mounting screws 46 and are positioned thereon. At both the left end and right end of trolley 340, the dependent plate 43 is typically spaced away from the body 41 by a short right circular cylindrical tubular second cylindrical spacer 49, which is concentrically mounted on a horizontal roller mounting screw 46 as shown in FIG. 6.

The actuator support crossbar 350 is a thick rectangular prismatic plate. The crossbar 350 is mounted horizontally at the bottom ends of the Y of the spaced apart parallel dependent plates 43 by means of mounting screws 52 engaged in the bottom holes of the plates 43 and drilled and tapped horizontal holes in crossbar 350. Crossbar 350 has on its center a vertical hanger screw hole 351. The hanger screw hole 351 mounts downwardly extending actuator hanger 367 for attaching to the choke actuator 203.

Transverse vertical attachment link 356 is a rectangular plate with a pair of through holes at its lower end symmetrically spaced apart from the plate vertical longitudinal midplane. A clearance through hole for the actuator screw 324 is located near the upper end of plate 356 on the vertical longitudinal midplane. Laterally offset equally to each side of the clearance hole in plate 356 are two through holes that are aligned with the bolt holes in driven nut 330 and with which the driven nut is attached to plate 356 using screw 18 and nut 19. In addition, the transverse face of the trolley body 41 has two horizontal drilled and tapped holes at midheight of the body plate 41and equispaced from the longitudinal centerplane of the body 41. The spacing of these holes in body 41 is the same as that of the lower holes in plate 356 and link attachment screws 357 are engaged through these holes to attach link plate 356 to the body 41 of trolley 340.

Figure 12:
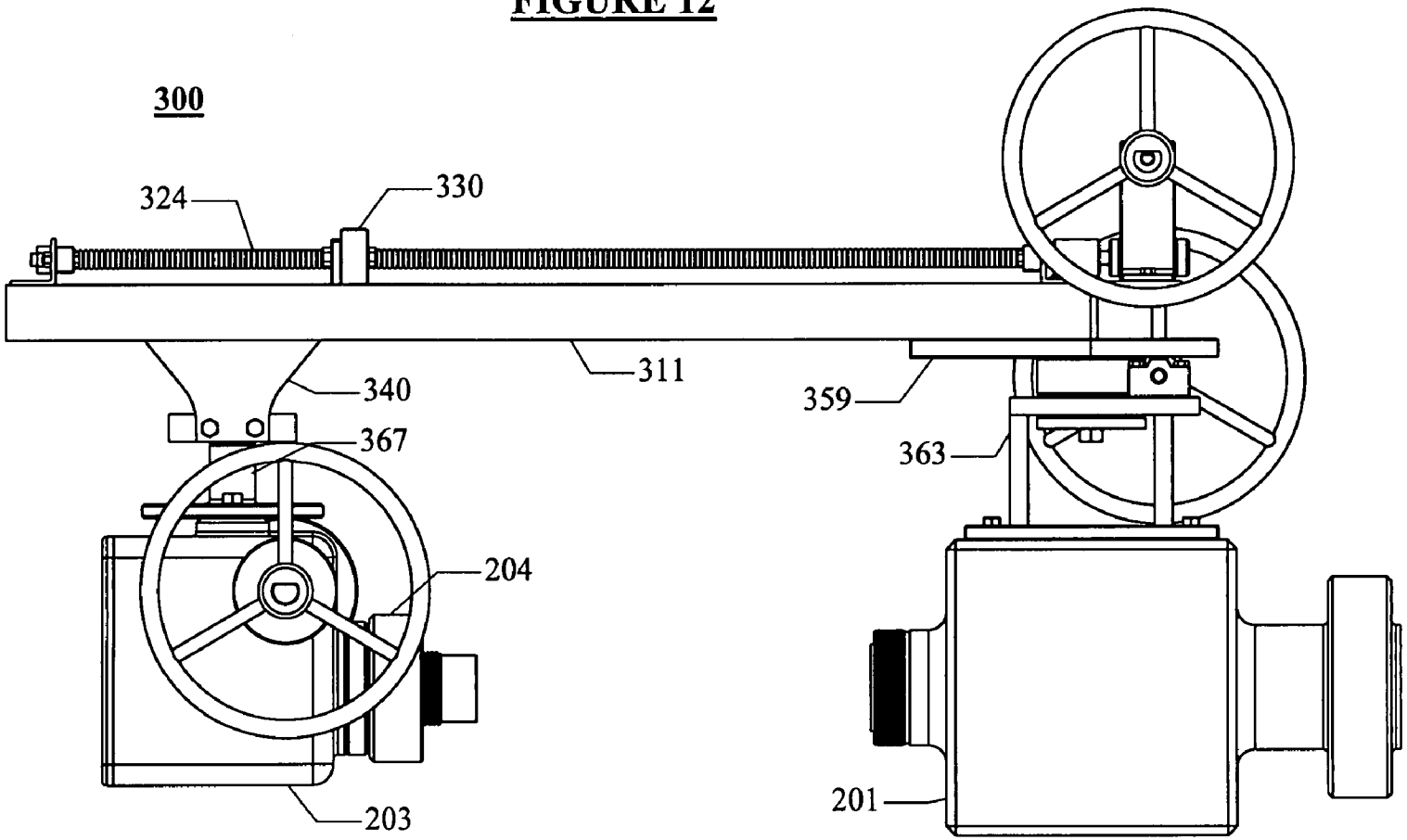
FIG. 12 is a profile view of the second manipulator embodiment shown in FIG. 9, with the trolley and the disconnected actuator displaced from the choke in the axial direction.

Rotator base 359, shown in FIG. 12, is attached to the bottom side of track 311 at its righthand end and serves to provide a rotatable support between the track assembly 311 and the choke valve 201. As seen in FIGS. 8 to 10, the rotator base 359 has a rotator upper plate 360, worm gear 361, rotator keeper nut 362, rotator keeper washer 396, rotator top bearing 397, and rotator bottom bearing 398.

The rotator upper plate 360 is a thick horizontal plate with one circular end and the other end squared. On the centerline of the circular portion of plate 360 and extending downwardly from the lower surface of the plate is worm gear 361. Worm gear 361 has a large diameter worm gear located on an upper cylindrical portion and a downwardly extending concentric reduced diameter right circular cylindrical lower hub joined to it by a transverse shoulder. The lower end of the hub of worm gear 361 has an upwardly extending drilled and tapped hole on its axis that is engagable by rotator keeper screw 362.

The rotator top bearing 397 is a transversely flanged thin walled right circular cylindrical tube having a bore which has a close slip fit to the lower hub of the worm gear 361 and a flange diameter the same as that of the toothed portion of worm gear 361. The bearing 397 is generally made of a lubricious plastic or a bearing bronze. The rotator bottom bearing 398 has the same outer diameter as the flange of bearing 397 and the same inner diameter as bearing 397. Rotator bottom bearing 398 is a thin annular ring typically made of the same material as that of the rotator top bearing 397.

The thick right circular cylindrical washer 396 has the same outer diameter as lower bearing 398 and a central clearance hole for accommodating rotator keeper screw 362. Rotator top bearing 397 is mounted on the hub of worm gear 361 with its flange abutting the downward facing shoulder of the gear. The lower bearing 398 is mounted on the upper surface of washer 396 and both are clamped to the lower end of the worm gear 361 by screw 362. The spacing between the flange of bearing 397 and the upper face of bearing 398 is slightly more than the thickness of the plate 365.

The rotator assembly 359 is assembled by the welding of the worm gear 361 to the rotator upper plate 360. The upper surface of the rotator upper plate 360 is welded to the bottom of the righthand end of the track assembly 311 so that the horizontal track centerline intersects the vertical centerline of the rotator assembly and the track extends in the direction of the squared end of the rotator upper plate 360.

The choke mounted base subassembly 363 has a horizontal rectangular upper pivot plate 365, two transverse riser plates 364, and two choke mounting bars 366. This subassembly mounts a handwheel driven worm 383 which is engaged to the worm gear 361 of the rotator base 359. Thick upper pivot plate 365 has a large circular through hole to journal bearing 397 of the rotator base 359. The lower side of the flange of bearing 397 and upper side of bearing 398 then can be supported on the upper and lower surfaces of the upper pivot plate 365, respectively.

A pattern of small vertical drilled and tapped holes is offset to one side of the pivot plate from the large through hole in the central portion of the plate. This hole pattern is for mounting the pillow blocks 385. The rectangular transverse riser plates 364 are attached to the lower transverse face of plate 365 by welding. A first riser plate 364 is attached to plate 365 with its outer transverse face flush with the transverse lefthand face of the plate 365. The second riser plate 364 is positioned parallel to the first symmetrically about the large center through hole, so that it is inward to the left from the righthand transverse edge of plate 365.

The choke mounting bars 366 are rectangular cross-section bars with symmetrically placed vertical through holes at their ends for accommodating choke attachment screws 392. The choke mounting bars 366 are welded horizontally transverse to and below the riser plates 364 at the outer ends of the riser plates 364. When assembled, the hole pattern in the choke mounting bars 366 corresponds to an identical pattern of drilled and tapped holes on the upper side of the body of choke valve 201 so that screws 392 can be used to attach the choke mounted base 363 to the choke.

A helically toothed worm 383 is concentrically mounted on an elongate cylindrical worm shaft 384 and supported by two bearing pillow blocks 385. One pillow block is positioned adjacent a first end of the shaft 384, while the other pillow block is set back from the second end of the shaft. The second end of the shaft 384 has a flat provided whereby another handwheel 38 can be mounted at the second end for selectably driving the shaft. The height of the pillow blocks 385 is such that, when the pillow blocks 385 are mounted onto the upper surface of plate 365 by screws 386, the worm 383 is properly positioned vertically with respect to worm gear 361 of the rotator base 359. The transverse positioning relative to the centerline of worm gear 361 of the mounting holes for the pillow blocks 385 on plate 365 is such that the worm 383 and the worm gear 361 are suitably meshed. The worm shaft 384 extends laterally sufficiently beyond the side of choke mounted base 363 that its handwheel 38 is freely accessible and the rotator base 359 is able to rotate through a large arc.

The actuator hanger 367 has a stepped vertical shaft with a large transverse flange 370 at its lower end. The upper end of hanger 367 has a male thread, below which is a concentric cylindrical shank. A transverse flange joins the lower end of the round cylindrical shank to the relatively larger diameter main round cylindrical body of the actuator hanger 367. Two diametrically opposite vertical holes are drilled in the flange 370 at the lower end of hanger 367 so that screws 94 can be used to engage the threaded holes in the bosses 206 of the choke actuator 203. Hanger washer 368 is a round disk washer with a central hole to accommodate the threaded section and the shank of hanger 367. The outer diameter of the washer 368 is generally the same as the diameter of the main cylindrical body of hanger 367.

Two thin flat annular bearing washers 369 are generally fabricated from a lubricious plastic or bearing bronze. The outer diameter of the bearings 369 correspond to both the outer diameter of hanger washer 368 and of the main round cylindrical body of the actuator hanger 367. The threaded portion and shank of actuator hanger 367 are assembled into the hanger screw hole 351 of the trolley 340 with a bearing 369 on each side of the actuator support crossbar 350 and the lower bearing abutting the transverse shoulder of the hanger, washer 368 on top of the upper bearing 369, and hanger nut 371 and hanger jam nut 372 engaged with the thread of hanger 367 to retain the bearings 369 and washer 368 in place. The nuts 371 and 372 are not made up so tightly that the hanger 367 cannot be readily rotated.

OPERATION OF THE INVENTION

The arrangements shown in the drawings of this document can be varied somewhat from what is shown herein without departing from the spirit of the present invention. Likewise, the operational sequence can be varied somewhat from what is described herein without departing from the spirit of the invention.

The operation of the first embodiment 10 of the present invention is as follows. The manipulator 10 is mounted to drilled and tapped holes in the upper surface of the choke valve 201 by means of screws 92 engaged through the vertical holes in the ends of the choke mounting bars 91. The track 11 is then positioned so that it extends outwardly on the actuator 203 side of the choke 201 and is aligned with the axis of the choke. The arrangement of the trolley assembly 39 is such that the lower surface of its actuator support crossbar 50 is coplanar with the top surfaces of the bosses 206 of the choke actuator 203.

The handwheel 38 is rotated, thereby causing driven nut 30 and trolley assembly 39 to move along track 11 until the holes 51 in the actuator support crossbar 50 are aligned with the corresponding holes in the bosses 206 of the choke actuator 203. Screws 94 are then engaged with the choke actuator by means of the holes in the bosses 206 so that the trolley assembly 39, the track 11, the track support members 90 and 91, and the rigidly mounted choke 201 are supporting the choke actuator 203. At this point, the attachment nut 204, which connects the choke actuator 203 and the internal valve components of the choke valve 201 to the choke valve body at its lefthand neck, is disconnected.

The handwheel 38 is then rotated so that the trolley assembly 39 and its attached actuator 203 and the internals of the choke valve 201 are withdrawn axially from choke body cavity. If it is desired to service these withdrawn components horizontally, then the trolley 39 is not moved onto the arcuate portion of the track 11. However, if it is desired to rotate the actuator 203 so that components do not readily drop out of the actuator housing during service, the trolley can be shifted sufficiently so that the first trolley 40 moves well up into the arcuate portion of the track, thereby tilting the lefthand, cover end of the actuator upwardly. The trolley assembly 39 is prevented from excessive outward travel by travel stop bar 34. The reassembly of the choke system uses a reverse procedure to the disassembly described above.

The operation of the second embodiment 300 of the present invention is as follows. The manipulator 300 is mounted to drilled and tapped holes in the upper surface of the choke valve 201 by means of screws 392 engaged through the vertical holes in the ends of the choke mounting bars 366. The track 311 is then positioned so that it extends outwardly on the actuator 203 side of the choke 201 and aligned with the axis of the choke. The arrangement of the trolley assembly 340 is such that the lower surface of its actuator support crossbar 350 is coplanar with the top surfaces of the bosses 206 of the choke actuator 203.

The first handwheel 38 is rotated causing driven nut 330 and trolley assembly 40 to be driven through gearbox 380 and the actuator screw 324 and to move along track 311 until the holes in the flange 370 of the actuator hanger 367 are aligned with the corresponding holes in the bosses 206 of the choke actuator 203. Screws 94 are then engaged with the actuator 203 by means of the holes in the bosses 206 so that the trolley assembly 340, the track 311, the rotator base 359, the choke mounted base 363, and the rigidly mounted choke 201 are supporting the actuator 203. At this point, the attachment nut 204, which connects the actuator 203 and the internal valve components of the choke valve 201 to the choke valve body at its lefthand neck, is disconnected.

The first handwheel 38 is then again rotated so that the trolley assembly 340 and its attached actuator 203 and the internals of the choke valve 201 are withdrawn axially from choke body cavity. If it is desired to rotate the choke actuator 203 in the horizontal plane so that components are more readily accessible, the actuator hanger 367 can be directly rotated.

Alternatively, the second handwheel 38 can actuate the worm 383 to drive worm gear 361 and rotate rotator base 359 and its attached track 311. Both rotational methods can be used together to achieve a desired alignment. Choke reassembly uses a reverse procedure of the disassembly described above.

ADVANTAGES OF THE INVENTION

The first embodiment 10 of the present invention permits servicing of the choke valve 201 and the choke actuator 203 at the height of the choke valve axis, which is normally an easier working position than at ground level. Additionally, it is very advantageous to be able to tilt the actuator upwardly so that its internal components are not so easily dropped during servicing.

The second embodiment 300 of the present invention permits the actuator 203 and the internals of the choke valve 201 to be swiveled in the horizontal plane so that they can be placed in a more conveniently accessible position. This is an important advantage when the choke is located in the middle of a complex flow manifold where conventional access would be problematic.

A common advantage to both embodiments 10 and 300 of the present invention is the reduced susceptibility to stick-slip movement of the trolley supporting the actuator 203 and the choke valve 201 components. This improvement is due to the screw drive and the gear drive arrangements for the manipulators, since these operational means are much smoother, stiffer, and more forceful than manually urging the suspended choke system components to new positions.

A further important advantage is that the mechanical advantage of the screw and/or gear drives of the present manipulators permits controlled movement of the suspended components of the choke even when the movements are not in a very level position. A common advantage for both types of manipulator is that is markedly eases the assembly and disassembly and servicing of the typically heavy components of the choke valve, leading to reduced strain and injury in service personnel and to reduced choke valve system component damage due to dropped or impacted components.

These and other advantages will be obvious to those skilled in the art. Although the present invention and its advantages have been described in detail, it should be understood that various changes, substitutions and alterations can be made herein without departing from the spirit and scope of the invention as defined by the appended claims.

What is claimed is:

1. A choke valve manipulator device comprising:

a frame;

a mounting means for attaching a choke valve to the frame; and a rotation means for rotating the choke valve about an axis of a horizontal plane;

whereby the manipulator device supports the weight of the choke valve and eases access to the choke valve components whenever the choke valve is serviced.

2. The choke manipulator device of claim 1, further comprising a support means for attaching a choke actuator to the frame.

3. The choke manipulator device of claim 2, further comprising a travel means for moving the supported choke actuator away from the supported choke valve.

4. A choke manipulator device comprising:

a frame;

a mounting means for attaching a choke valve to the frame; and a tilt means for tilting the choke valve in a vertical plane;

whereby the manipulator device supports the weight of the choke valve and eases access to the choke valve components whenever the choke valve is serviced.

5. The choke manipulator device of claim 4, further comprising a support means for attaching a choke actuator to the frame.

6. The choke manipulator device of claim 5, further comprising a travel means for moving the supported choke actuator away from the supported choke valve.

7. A choke manipulator device comprising:

a frame having an elongated track;

a choke valve attachment structure positioned on an underside of the track;

a reciprocable trolley, wherein the trolley moves along a length of the track;

a trolley actuator in communication with the trolley, the trolley actuator causing the trolley to move along the length of the track; and a choke actuator attachment mechanism positioned on an underside of the trolley;

whereby when the trolley is moved the choke actuator attachment is moved in the same direction.

8. The choke manipulator device of claim 7, wherein the choke attachment structure is rotatable about an axis of a horizontal plane.

9. The choke manipulator device of claim 7, wherein the track includes two parallel mirror image channels.

10. The choke manipulator device of claim 7, wherein the track has a linear section and a 90° arcuate curved end segment distal to the choke valve attachment structure.

11. The choke manipulator device of claim 9, wherein the parallel mirror image channels are connected with a plurality of crossmembers.

12. The choke manipulator device of claim 7, wherein the trolley actuator is a rod having a threaded central section.

13. The choke manipulator device of claim 12, wherein the trolley is connected to a nonrotating driven nut having a threaded aperture, whereby the threaded aperture of the driven nut is mated with the threaded central section of the trolley actuator so that when the trolley actuator is rotated the driven nut will selectably reciprocate along the threaded central section of the trolley actuator causing the trolley to move.

14. The choke manipulator device of claim 7, wherein the trolley has vertical restraint rollers and horizontal restraint rollers mounted on the trolley, the vertical and horizontal restraint rollers maintain the trolley within the track.

15. A choke manipulator device comprising:

a frame having an elongated track including two parallel mirror image channels;

a choke valve attachment structure positioned on an underside of the track, the choke valve attachment structure rotatable about an axis of a horizontal plane;

a reciprocable trolley having a plurality of mounted rollers, the rollers maintaining the trolley with the track;

a trolley actuator in communication with the trolley, the trolley actuator causing the trolley to selectably reciprocate along a length of the track; and a choke actuator attachment mechanism positioned on an underside of the trolley;

whereby whenever the trolley actuator moves the trolley the choke actuator attachment mechanism moves in the same direction as the trolley.

16. The choke manipulator device of claim 15, wherein the parallel mirror image channels are connected with a plurality of crossmembers.

17. The choke manipulator device of claim 15, wherein the track has a linear section and a curved section.

18. The choke manipulator device of claim 15, wherein the trolley actuator is a rod having a threaded central section.

19. The choke manipulator device of claim 18, wherein the trolley is connected to a nonrotating driven nut having a threaded aperture, whereby the threaded aperture of the driven nut is mated with the threaded central section of the trolley actuator so that when the trolley actuator is rotated the driven nut will selectably reciprocate along the threaded central section of the trolley actuator causing the trolley to move.

20. A method for servicing a choke valve system, said method comprising the steps of:

(i) positioning a choke valve manipulation device close to the choke valve system to be serviced, the choke valve manipulation device comprising:

a frame having an elongated track, a choke valve attachment structure positioned on an underside of the track, a reciprocable trolley, wherein the trolley moves along a length of the track, a trolley actuator in communication with the trolley, the trolley actuator causing the trolley to move along the length of the track, and a choke actuator attachment mechanism positioned on an underside of the trolley;

(ii) attaching a choke valve to the choke valve attachment structure;

(iii) aligning the choke actuator attachment mechanism with a choke actuator connected to the choke valve;

(iv) attaching the choke actuator to the choke actuator attachment mechanism;

(v) disconnecting the choke actuator from the choke valve;

(vi) activating the trolley actuator to cause the trolley to move away from the choke valve to separate the choke valve from the choke actuator; and (v) evaluating an interior component of the choke valve system for replacement or repair.

21. The method for servicing a choke valve system of claim 20, said method further comprising the step of rotating the attached choke valve.

* * * * *